US011773519B2

(12) United States Patent
Myogi et al.

(10) Patent No.: US 11,773,519 B2
(45) Date of Patent: Oct. 3, 2023

(54) LOOM

(71) Applicant: TSUDAKOMA KOGYO KABUSHIKI KAISHA, Ishikawa-ken (JP)

(72) Inventors: Keiichi Myogi, Ishikawa-ken (JP); Daigo Yamagishi, Ishikawa-ken (JP); Koichi Tamura, Ishikawa-ken (JP); Kazuya Yama, Ishikawa-ken (JP)

(73) Assignee: TSUDAKOMA KOGYO KABUSHIKI KAISHA, Ishikawa-Ken (JP)

( * ) Notice: Subject to any disclaimer, the term of this patent is extended or adjusted under 35 U.S.C. 154(b) by 3 days.

(21) Appl. No.: 17/486,138

(22) Filed: Sep. 27, 2021

(65) Prior Publication Data

US 2022/0127762 A1 Apr. 28, 2022

(30) Foreign Application Priority Data

Oct. 27, 2020 (JP) ..... 2020-179477

(51) Int. Cl.
*D03D 49/02* (2006.01)
*D03D 47/30* (2006.01)
*D03D 49/00* (2006.01)

(52) U.S. Cl.
CPC ..... *D03D 47/3053* (2013.01); *D03D 47/3093* (2013.01)

(58) Field of Classification Search
CPC ..... D03D 47/3053; D03D 47/3093; D03D 49/02; D03D 49/027; D03D 47/3033; D03D 49/022; D03J 1/005; D03J 1/006
See application file for complete search history.

(56) References Cited

U.S. PATENT DOCUMENTS 6,095,449 A * 8/2000 Gallo ..... G01L 5/107 242/419.1
6,292,989 B1 * 9/2001 Nomura ..... D02H 3/00 28/187
6,431,220 B1 * 8/2002 Nakada ..... D03D 49/20 139/311

(Continued)

FOREIGN PATENT DOCUMENTS

JP H05-030183 U 4/1993
JP H06-010391 U 2/1994

OTHER PUBLICATIONS

Mar. 7, 2022, European Search Report issued for related EP Application No. 21199466.0.

*Primary Examiner* — Robert H Muromoto, Jr.
(74) *Attorney, Agent, or Firm* — Paratus Law Group, PLLC

(57) ABSTRACT

A loom includes a display setting device including a display panel and a base mount to which the display panel is attached; a support mechanism configured to support the display setting device on the base mount via a support member attached to a side frame of a loom frame and extending toward an outer side of the frame; and a vibration-proof structure configured to support the base mount on the support member of the support mechanism via an elastic member, wherein the vibration-proof structure has a configuration where a support structure member provided to the loom is suspended from the base mount.

8 Claims, 4 Drawing Sheets

(56) References Cited

U.S. PATENT DOCUMENTS

| | | | | |
|---|---|---|---|---|
| 8,175,740 | B2 * | 5/2012 | Lamprillo | B65H 59/06 700/130 |
| 2004/0113894 | A1 * | 6/2004 | Yamamoto | D03J 1/005 345/173 |
| 2019/0352813 | A1 * | 11/2019 | Tolle | D03D 47/25 |

* cited by examiner

LOOM

CROSS-REFERENCE TO RELATED APPLICATION(S)

This application is based on and claims priority under 35 USC 119 from Japanese Patent Application No. 2020-179477 filed on Oct. 27, 2020, the contents of which are incorporated herein by reference.

TECHNICAL FIELD

The present invention relates to a loom including a display setting device including a display panel and a base mount to which the display panel is attached, a support mechanism configured to support the display setting device on the base mount via a support member attached to a side frame of a loom frame and extending toward an outer side of the frame, and a vibration-proof structure configured to support the base mount on the support member of the support mechanism via an elastic member.

BACKGROUND ART

A loom includes a display setting device by which setting values relating to weaving conditions and the like can be input and set and the setting values can be displayed. Note that, in a recent loom, the display setting device generally adopts a touch panel-type display panel having a display screen on which an input setting can be performed. The display setting device includes the display panel, and a base mount, which is a base part of the display setting device and the display panel is attached thereto. The display setting device is supported by a support stand as a support member attached to a side frame of a loom frame in a form of extending outward and is thus attached to the frame (side frame).

It is known that the loom frame vibrates due to a beating operation during weaving. For this reason, the vibrations are transmitted to the display setting device attached to the frame, which may cause a malfunction or damage of the display panel. Therefore. Patent Literature 1 suggests a configuration of making it difficult for the vibrations to be transmitted to the display setting device so as to prevent the malfunction or the like of the display panel.

The configuration disclosed in Patent Literature 1 is a vibration-proof structure for the display setting device where an elastic member is mounted between a stay configured to support the display setting device as described above and the display setting device. Specifically, in the vibration-proof structure, the display setting device is supported by the support member (side frame) via the elastic member. Therefore, according to the configuration, the vibrations are absorbed by the elastic member, so that the vibrations of the display setting device itself are reduced, as compared to a configuration where the display setting device is directly supported by the support member.

CITATION LIST

Patent Literature

Patent Literature 1: JPH05-30183U

SUMMARY OF INVENTION

However, the vibration-proof structure of Patent Literature 1 has a problem that the vibrations of the display setting device itself are not sufficiently suppressed. More specifically, in the vibration-proof structure of Patent Literature 1, since the display setting device is supported via the elastic member by the side frame (support member), the support state is more unstable, as compared to the configuration where the display setting device is directly supported by the support member. In addition, in the vibration-proof structure of Patent Literature 1, since the display setting device and a member integrally attached to the display setting device are all supported in a form of being positioned above the support member, positions of the centers of gravity of the supported objects are above support positions by the support member (elastic member).

In this case, in the vibration-proof structure, the vibrations of the frame are not completely absorbed by the elastic member, so that the vibrations are transmitted to the supported objects to some extent. Therefore, due to the fact that the supported objects are supported in the above-described state, the supported objects vibrate more than the vibrations transmitted from the elastic member based on the vibrations of the frame. As a result, although the elastic member is expected to have a vibration-proofing effect, the vibrations are not reduced as expected, and when an operating speed of the loom is very high, a malfunction may occur in the display panel.

It is therefore an object of the present invention to provide a loom including a vibration-proof structure for a display setting device capable of suppressing vibrations of the display setting device itself as much as possible.

A preamble of the present invention is a loom including a display setting device including a display panel and a base mount to which the display panel is attached, a support mechanism configured to support the display setting device on the base mount via a support member attached to a side frame of a loom frame and extending toward an outer side of the frame, and a vibration-proof structure configured to support the base mount on the support member of the support mechanism via an elastic member.

In order to achieve the above object, the loom of the present invention having the preamble is characterized in that the vibration-proof structure has a configuration where a support structure member provided to the loom is suspended from the base mount.

In addition, in the loom of the present invention, when the loom is an air jet loom including a regulator for regulating a pressure of a compressed air to be supplied to a weft insertion nozzle, the support structure member may be a regulator panel configured to support the regulator. In addition, the support structure member may be a cover bracket configured to support an exterior cover of the loom.

In addition, when the loom is an air jet loom including an electric component box in which an electric component for controlling an operation of the loom is accommodated, the electric component box being supported by the side frame via a base member attached to the side frame and being arranged in the vicinity of the support structure member on an outer side of the frame, the electric component box may be attached to the base member via an elastic member, and the support structure member and the electric component box may be connected to each other via a connecting member.

According to the loom of the present invention, the loom is configured in such an aspect that the vibration-proof structure has the configuration where the support structure member originally provided to the loom is suspended from the base mount of the display setting device. Specifically, the supported object supported on the side frame by the support member includes the display setting device supported by the support member via the elastic member and the support structure member that is supported in a form of being suspended from the display setting device. Therefore, in this configuration, as compared to a configuration where the supported objects are all supported in a form of being positioned above the support member, the positions of the centers of gravity of the supported objects are located lower. Thereby, according to this configuration, as compared to the configuration where the supported objects are all supported in a form of being positioned above the support member, the vibrations of the display setting device itself are suppressed as much as possible.

Further, according to the present invention, the loom is configured to suspend the member from the display setting device (base mount) so as to lower a position of the center of gravity of the supported object but the support structure member originally provided to the loom is used as the member to be suspended. Thereby, since it is possible to lower the position of the center of gravity of the supported object without a dedicated member such as a weight, it is possible to achieve the above object without increasing the manufacturing cost of the loom.

Further, in the general air jet loom, a regulator panel configured to support a regulator for regulating a pressure of a compressed air to be supplied to a weft insertion nozzle is provided below the display setting device. Therefore, when the loom is an air jet loom, the regulator panel is used as the support structure member, so that it is possible to realize the configuration of the present invention for achieving the above object without making a significant change to the conventional loom.

Further, in a case where the regulator panel is used as the support structure member, since the regulators corresponding to the weft insertion nozzles are supported by the regulator panel, a weight of a part to be suspended from the display setting device, including the regulator panel and the regulators, is generally heavier than a weight of the display setting device supported above the support member. Therefore, the regulator panel is used as the support structure member suspended from the display setting device, so that the position of the center of gravity of the supported object supported by the support member is located below the support member. Thereby, the vibrations of the supported object due to the transmitted vibrations are further suppressed, so that the vibrations of the display setting device itself are further suppressed.

In addition, a general loom is provided with an exterior cover, and the exterior cover is directly supported on the side frame by a cover bracket. For this reason, the vibrations of the frame (side frame) as described above are directly transmitted to the exterior cover via the cover bracket, so that when the vibrations are high, such as a case where the operating speed of the loom is high, the exterior cover may be damaged.

In contrast, according to the present invention, the cover bracket is used as the support structure member suspended from the display setting device, so that the exterior cover is included in the supported object and is supported by the display setting device (base mount). As described above, the support structure member is suspended from the display setting device, so that the vibrations of the display setting device are suppressed as much as possible. As a result, the vibrations of the exterior cover supported by the display setting device are also suppressed. Thereby, even when the vibrations of the frame (side frame) are high, the damage of the exterior cover can be prevented as much as possible.

In addition, in the case where the loom is an air jet loom, the electric component box is supported via the elastic member and the support structure member suspended from the display setting device is connected to the electric component box, so that the vibrations of the display setting device itself are further suppressed.

Specifically, the general air jet loom has the electric component box in which an electric component for controlling an operation of the loom is accommodated. The electric component box is provided in a form of being supported on the side frame by the base member attached to the side frame, in the vicinity of an outer side of the side frame on a yarn supply-side configured to support the display setting device. Therefore, the loom is made to have a configuration where the electric component box is attached to the base member via the elastic member and then the electric component box and the support structure member suspended from the display setting device are connected to each other via the connecting member. According to this configuration, since a part of the weight of the electric component box is applied to the support structure member, the position of the center of gravity of the supported object is located lower, as compared to a configuration where only the support structure member is suspended from the display setting device. Thereby, as compared to the configuration where only the support structure member is suspended from the display setting device, the vibrations of the display setting device itself are further suppressed.

DESCRIPTION OF EMBODIMENTS

Hereinafter, one embodiment of the loom of the present invention will be described with reference to FIGS. 1 to 4. Note that, in the present embodiment, the loom is an air jet loom.

Figure 1:
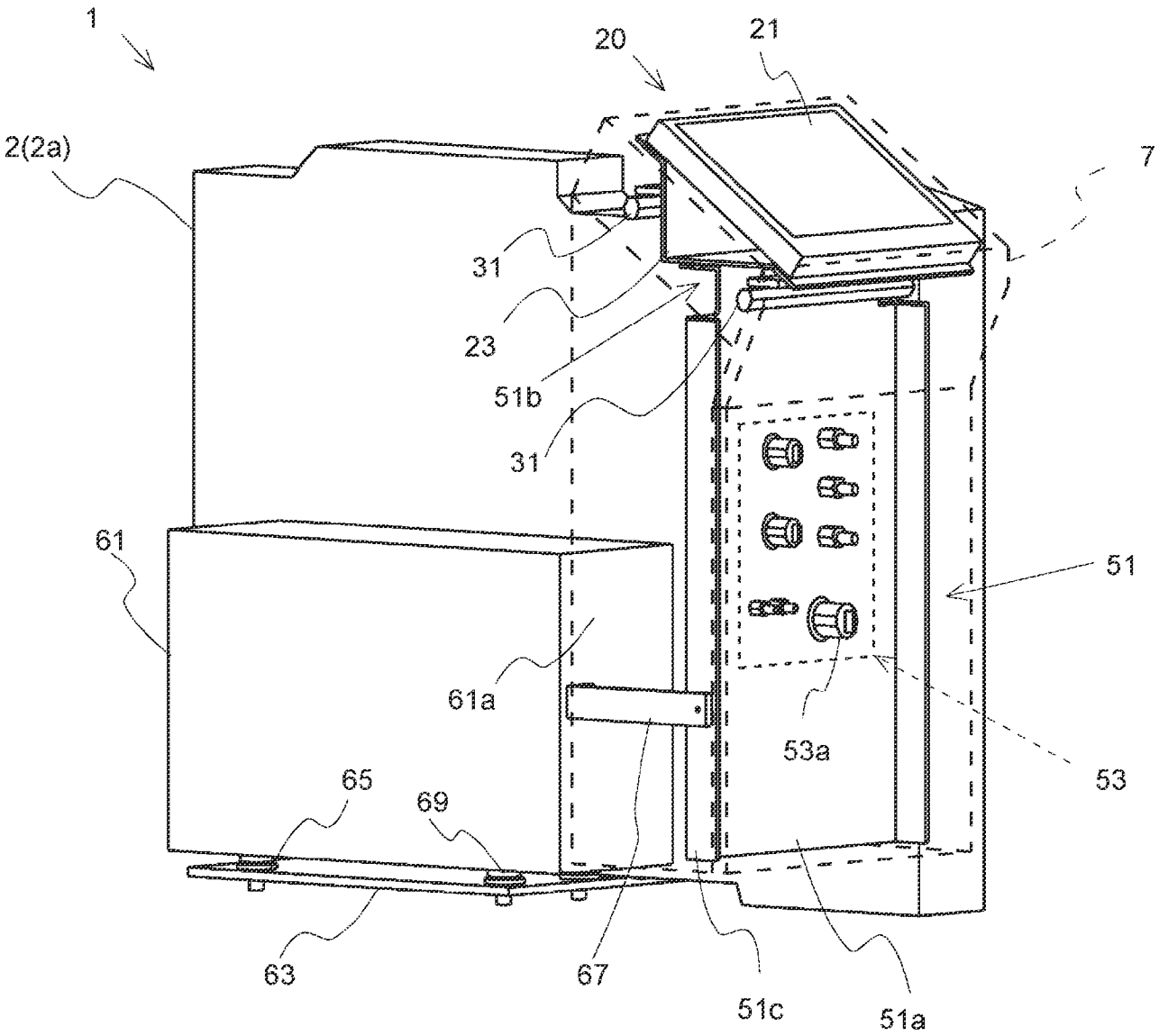
FIG. 1 is a perspective view showing a loom to which the present invention is applied.
Figure 2:
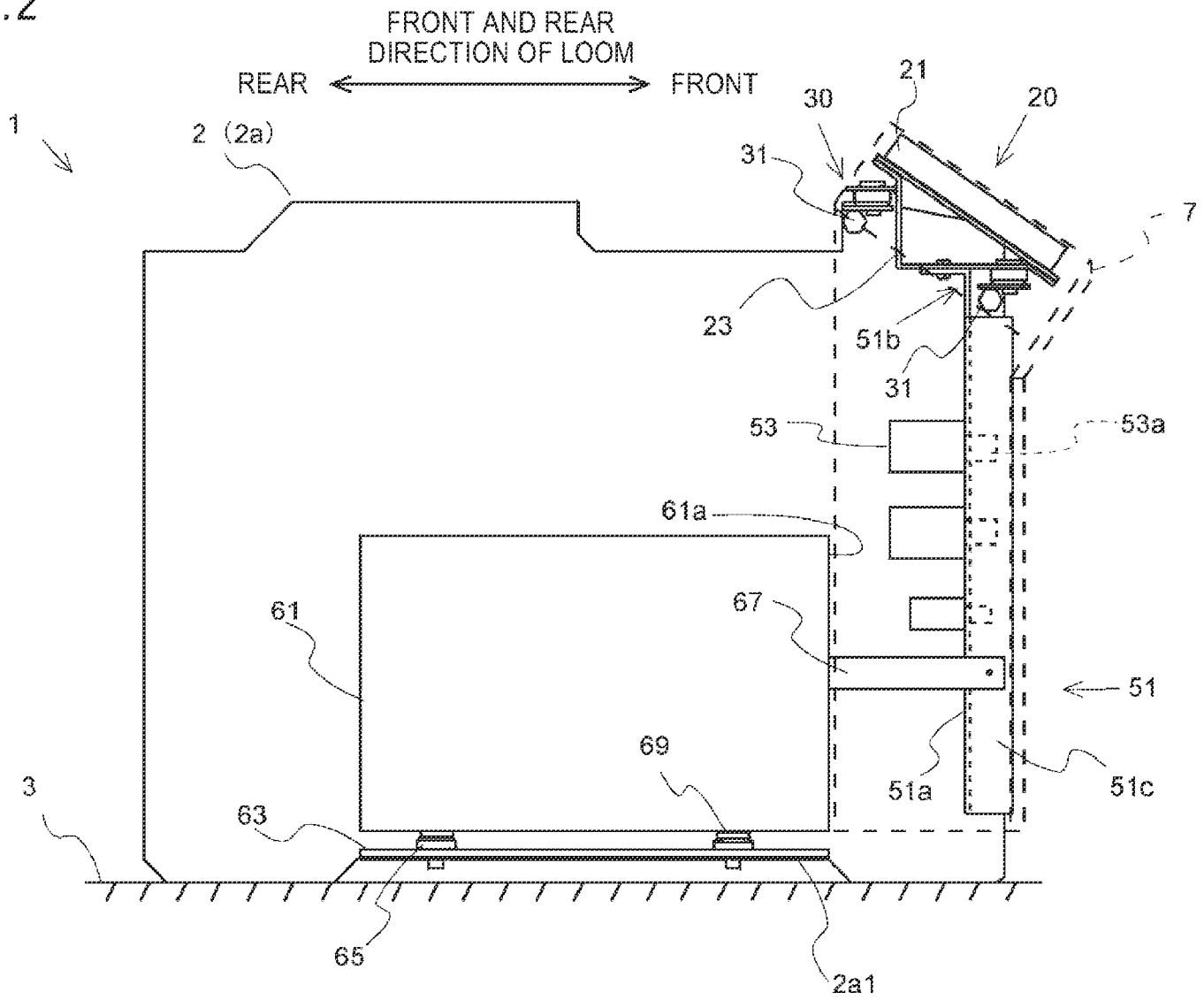
FIG. 2 is a side view showing the loom to which the present invention is applied.

In an air jet loom 1, a frame 2 has a pair of side frames, as a main body, and both the side frames are connected by a plurality of beam members (not shown). In FIGS. 1 and 2, only one side frame 2*a* arranged on a yarn supply-side of the pair of side frames is shown. As shown in FIG. 2, the side frame 2*a* has a bottom surface recessed at an intermediate part in a front and rear direction (a direction that is, in a horizontal direction, orthogonal to a facing direction (width direction) of both the side frames). Specifically, the bottom surface of the side frame 2*a* has a non-contact part 2*a*1 that is not in contact with a bottom surface 3. Note that, in descriptions below, a winding side of a woven fabric is referred to as the front and a delivery-side of the warp is referred to as the rear, with respect to each position in the front and rear direction.

The air jet loom 1 includes a display setting device 20 for displaying setting values relating to weaving conditions and the like and performing an input setting. The display setting device 20 is arranged to be located on a side of a front and upper part of the side frame 2*a*, on an outer side of the frame 2 on the yarn supply-side. The display setting device 20 includes a touch panel-type display panel 21 configured to perform the display of the setting values and the input setting on a display screen thereof, and a base mount 23 to which the display panel 21 is attached.

Figure 3:
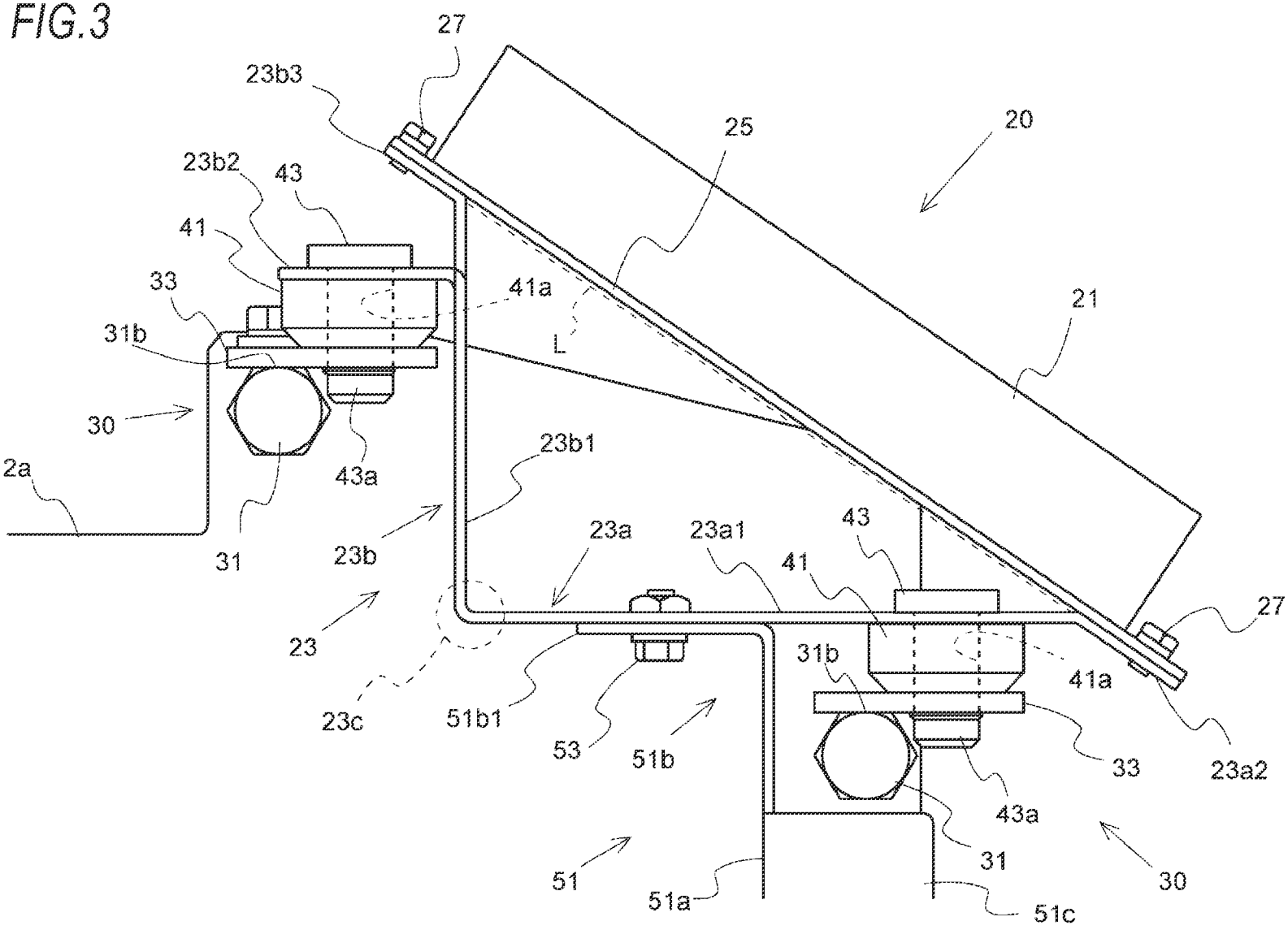
FIG. 3 is an enlarged side view showing main parts of FIG. 2.

More specifically, as shown in FIGS. 2 and 3, the base mount 23 is formed to have a substantial L-shape by bending a plate-shaped member, as seen in an extension direction (width direction) of a bent part 23*c*, and has a first part 23*a*, which is a part on one end-side of the bent part 23*c*, and a second part 23*b*, which is a part on the other end-side. The first part 23*a* is formed so that an end portion on an opposite side to the bent part 23*c* is bent toward an opposite side (outer side) to a bending direction of the bent part 23*c*. Specifically, the first part 23*a* is formed to have a base portion 23*a*1 extending from the bent part 23*c*, and a lower attaching portion 23*a*2 continuing to the base portion 23*a*1 on an opposite side to the bent part 23*c* and bent toward the outer side with respect to the base portion 23*a*1.

Figure 4:
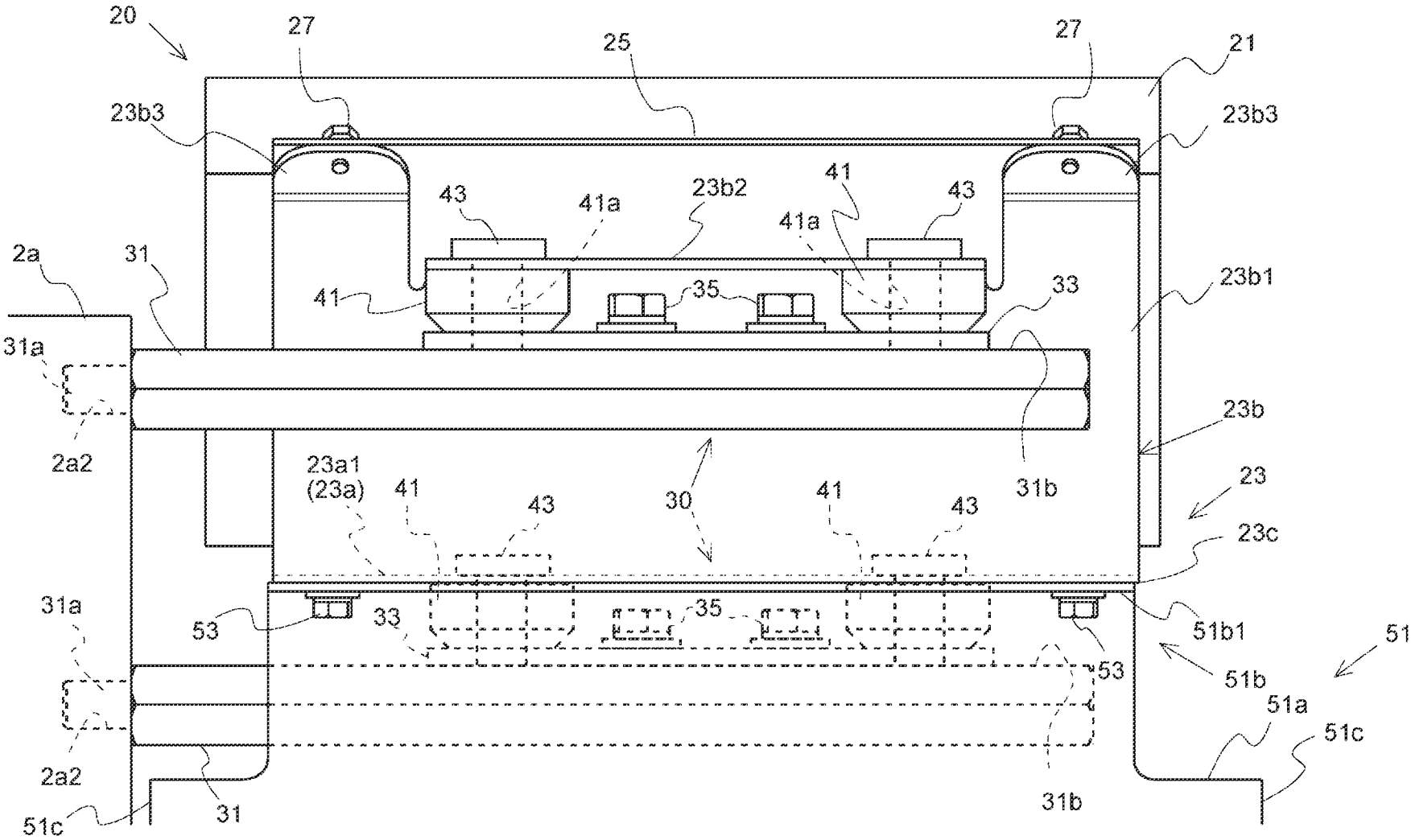
FIG. 4 is a rear view of FIG. 3.

As shown in FIG. 4, the second part 23*b* is formed so that a part including an end portion on an opposite side to the bent part 23*c* is divided into three portions in the width direction. A support portion 23*b*2, which is a central portion in the width direction, is bent toward an opposite side (outer side) to the bending direction of the bent part 23*c* so as to be substantially orthogonal to a connection portion 23*b*1 that is a portion closer to the bent part 23*c* than the divided portion.

The two portions positioned on both sides of the support portion 23*b*2 in the width direction are formed so that the end portion is bent toward the outer side. Specifically, the portions on both sides each have a portion extending on the same side as the connection portion 23*b*1 and an upper attaching portion 23*b*3 that is a portion bent toward the outer side at the end portion. Note that, the portion, which is closer to the connection portion 23*b*1 than the upper attaching portion 23*b*3, of each of the portions on both sides can be regarded as a portion extending from the connection portion 23*b*1 and is thus regarded as a part of the connection portion 23*b*1, in the below.

In addition, as shown in FIG. 3, a bent angle of the lower attaching portion 23*a*2 with respect to the base portion 23*a*1 of the first part 23*a* and a bent angle of the upper attaching portion 23*b*3 with respect to the connection portion 23*b*1 of the second part 23*b* are set so that an extension direction of the lower attaching portion 23*a*2 from the base portion 23*a*1 and an extension direction of the upper attaching portion 23*b*3 from the connection portion 23*b*1 are parallel to each other. Specifically, as seen in the width direction, the bent angles are set so that the lower attaching portion 23*a*2 and the upper attaching portion 23*b*3 extend from the base portion 23*a*1 and the connection portion 23*b*1 in a form of being parallel to a virtual line L connecting an end edge of the base portion 23*a*1 on the lower attaching portion 23*a*2-side and an end edge of the connection portion 23*b*1 on the upper attaching portion 23*b*3-side.

The display panel 21 has a display screen for performing a display of the setting values and an input setting, and the display screen is a touch panel type, as described above. The display setting device 20 also has a plate-shaped attachment member 25 for attaching the display panel 21 to the base mount 23. The attachment member 25 is attached to the display panel 21 in a form of being fixed to a lower surface (an end face on an opposite side to the display screen-side) of the display panel 21. The attachment member 25 is attached in a form of being placed on the lower attaching portion 23*a*2 and the upper attaching portion 23*b*3 of the base mount 23, so that the display panel 21 is attached to the base mount 23. Note that, the attachment member 25 is attached to the base mount 23 by using screw members 27.

The display setting device 20 configured as described above is supported by a support mechanism 30 including support stays 31 as the support members attached to the side frame 2*a*. More specifically, as shown in FIGS. 3 and 4, the support mechanism 30 includes two support stays 31 and 31. Each support stay 31 is a member mainly consisting of a hexagonal columnar part, and is formed as a member whose dimension in a length direction of the hexagonal columnar part is greater than a dimension of the base mount 23 in the width direction. Further, each support stay 31 has a male thread part 31*a* at one end.

The male thread part 31*a* is screwed into a female thread hole 2*a*2 formed in an outer wall of the side frame 2*a*, so that each support stay 31 is attached to the side frame 2*a* in a form of extending toward an outer side of the frame 2. In the meantime, the attachment positions are positions close to the upper front side of the side frame 2*a* (outer wall) because the display setting device 20 is provided in the above-described position. Also, the attachment positions are set so that one support stay 31 is positioned ahead of the other support stay 31 with respect to the front and rear direction and the other support stay 31 is positioned above one support stay 31 with respect to the upper and lower direction. Further, each support stay 31 is attached so that one of six side surfaces of the hexagonal columnar part faces upward perpendicularly. Note that, the side surface facing upward perpendicularly becomes a support surface 31*b* for supporting the display setting device 20 via a support plate and the like, which will be described later.

The support mechanism 30 also includes support plates 33 for attaching the display setting device 20 (base mount 23) to the support stays 31. The support plates 33 are each provided for each of the support stays 31. Note that, each support plate 33 is a plate-shaped member having a rectangular section, as seen in a plate thickness direction. Note that, a dimension in a long side direction of an end face of the support plate 33 is substantially the same as a dimension in the width direction of the support portion 23*b*2 of the base mount 23. In addition, a dimension in a short side direction of the end face of the support plate 33 is larger than a width dimension of the support surface 31*b* of the support stay 31, and is about twice as large as the support stay 31, as seen from above.

Each support plate 33 is attached to the support surface 31*b* of the corresponding support stay 31 in such a form that the long side direction matches the length direction of the support stay 31 and the end face is in contact with the support surface 31*b*. The attachment is performed with respect to the short side direction in such a form that a part on one end-side in the short side direction is positioned on the support surface 31*b*. Therefore, in the attached state, a part on the other end-side of the support plate 33 in the short side direction protrudes forward from the support stay 31. Note that, the support plate 33 is attached to the support stay 31 by using screw members 35 in a form of screwing the screw members 35 inserted in through-holes (not shown) formed in the support plate 33 into the support stay 31.

The display setting device 20 is supported by the support mechanism 30 including the two support stays 31 and the support plates 33 each attached to each of the support stays 31. At this time, the supporting is made via an elastic member. Specifically, the air jet loom 1 has a vibration-proof structure configured to support, via an elastic member, the display setting device 20 (base mount 23) on the support plates 33 attached to the support stays 31 (support members) of the support mechanism 30.

More specifically, the base mount 23 is attached in a state of being placed on the support plates 33, so that the display setting device 20 is supported by the two support stays 31 and 31. Specifically, the display setting device 20 is supported by both the support stays 31 and 31 in such a form that the base portion 23*a*1 of the base mount 23 is placed on one support plate 33 attached to the lower support stay 31 and the support portion 23*b*2 is placed on the other support plate 33 attached to the upper support stay 31.

In addition, the base mount 23 is attached to each support plate 33 by using support pins 43. To this end, the base portion 23*a*1 of the base mount 23 is formed with two through-holes (not shown) configured to insert shaft portions 43*a* of the support pins 43 and provided at an interval in the width direction of the base mount 23. In addition, the one support plate 33 is also formed with two through-holes (not shown) aligned in the long side direction at the same interval as the two through-holes of the base portion 23*a*1. The support portion 23*b*2 of the base mount 23 is also formed with two through-holes (not shown) configured to insert the shaft portions 43*a* of the support pins 43 and provided at an interval in the width direction of the base mount 23. In addition, the other support plate 33 is also formed with two through-holes (not shown) aligned in the long side direction at the same interval as the two through-holes of the support portion 23*b*2.

Note that, the two through-holes of each support plate 33 are formed to penetrate through, in the plate thickness direction, a part of the support plate 33 protruding forward from the support stay 31.

As for positions in the long side direction of the through-holes of each support plate 33, positions of the through-holes of the one support plate 33 are formed so that, in a state where positions of the through-holes of the base portion 23*a*1 of the base mount 23 are matched with the through-holes, centers of both the through-holes are substantially matched with respect to the width direction of the base mount 23 (the long side direction of the support plate 33). In addition, positions of the through-holes of the other support plate 33 are formed so that, in the state where the positions of the through-holes of the base portion 23*a*1 are matched with the through-holes of the one support plate 33 as described above, the positions of the through-holes are matched with positions of the through-holes of the support portion 23*b*2 of the base mount 23 to cause a center of the other support plate 33 and a center of the support portion 23*b*2 to substantially match each other in the width direction.

Further, in a state where the positions of the through-holes are matched as described above, each support plate 33 is attached to the corresponding support stay 31 so that the base mount 23 (display setting device 20) is positioned in the vicinity of the outer wall of the side frame 2*a* and a presence range thereof overlaps the support stay 31 over a substantially entire range, with respect to the width direction.

In the state where the positions of the through-holes of each support plate 33 are matched with the positions of the through-holes of the base portion 23*a*1 and the support portion 23*b*2 of the base mount 23, as described above, the support pins 43 are each inserted into each of the through-holes from the base portion 23*a*1 and the support portion 23*b*2. Thereby, the base mount 23 is attached to each support plate 33 by the support pins 43.

In the attached state, support rings 41 formed as the elastic members are mounted between the base mount 23 and each support plate 33. Specifically, the base mount 23 is supported by each support plate 33 via the elastic members (support rings 41), as described above.

More specifically, the support ring 41 is formed by the elastic member, as described above, and is a ring-shaped member having a through-hole 41*a*. The support ring 41 is provided for each of the support pins 43 that are inserted into the base mount 23 (the base portion 23*a*1 and the support portion 23*b*2) and each support plate 33, and is provided between the base mount 23 (the base portion 23*a*1 and the support portion 23*b*2) and each support plate 33 in such a form that the corresponding support pin 43 is inserted in the through-hole 41*a*. Therefore, the base mount 23 (display setting device 20) is supported by the support mechanism 30 in a state where the weight of the base mount is received by the support rings 41 on each support plate 33. In this way, the air jet loom 1 includes the vibration-proof structure for the display setting device 20 where the display setting device 20 is supported by the support mechanism 30 via the support rings 41 (elastic members).

In the present embodiment, as shown in FIGS. 1 and 2, the air jet loom 1 includes a housing-shaped electric component box 61 in which an electric component for controlling an operation of the loom is accommodated, at a side of a lower side of the side frame 2*a* on the outer side of the frame 2 on the yarn supply-side.

More specifically, a base member 63 for supporting the electric component box 61 is attached to the non-contact part 2*a*1 of the side frame 2*a* (a concave part of the bottom surface of the side frame 2*a* that is not in contact with the bottom surface 3). Note that, in the present embodiment, the base member 63 is a plate-shaped member having a rectangular section, as seen in a plate thickness direction. The base member 63 is fixed to the side frame 2*a* in a state of being in contact with the non-contact part 2*a*1, and is provided in a form of protruding from the side frame 2*a* toward an outer side of the frame 2. In addition, the electric component box 61 is provided in a form of being placed on the protruding part of the base member 63 from the side frame 2*a*.

Note that, the electric component box 61 is formed as a housing having rectangular upper and bottom surfaces. The electric component box 61 is provided in a state where a long side direction of the upper surface (bottom surface) is made to match the front and rear direction (a short side direction is made to match the width direction). Also, in the state of being provided on the base member 63, the electric component box 61 is in a state where a position of a side surface (front surface 61*a*) facing toward the front is substantially the same as the rear support stay 31 of the two support stays 31 of the support mechanism 30 in the front and rear direction.

Additionally describing, as for the electric component box 61, the electric component for controlling an operation of the loom includes electric components for controlling operations of each device provided for the loom, such as a weft insertion-related device for weft insertion, a delivery-related device for warp delivery, and an opening-related device for driving a heddle frame according to a preset opening pattern.

In the loom configured as described above, according to the present invention, the vibration-proof structure for the display setting device 20 is configured to include a structure where the support structure member provided for the loom is suspended from the base mount 23, in addition to the above-described structure using the support rings 41. In addition, in the present embodiment, as an example of the support structure member, a regulator panel configured to support a regulator for regulating a pressure of a compressed air that is supplied to a weft insertion nozzle is used. The regulator panel also serves as a cover bracket configured to support an exterior cover of the loom. Also, in the present embodiment, the electric component box 61 is provided in a form of being supported by the side frame 2*a* via the elastic member, and is connected to the regulator panel (support structure member) via a connecting member. An embodiment (present embodiment) of the loom (air jet loom 1) is described in detail, as follows.

In the present embodiment, the air jet loom 1 includes a plurality of weft insertion nozzles (not shown), and regulators 53 provided for each weft insertion nozzle so as to regulate a pressure of a compressed air that is supplied to each weft insertion nozzle. Each regulator 53 is supported by a regulator panel 51.

As shown in FIGS. 1 and 2 showing the regulator panel 51, the regulator panel 51 is formed as a plate-shaped member. More specifically, the regulator panel 51 has such a shape that both end portions in a short side direction of an end face of a rectangular plate member as seen in a plate thickness direction are bent at substantially right angles. The regulator panel 51 is configured to support the regulators 53 at a part between both the bent end portions, and the part is configured as a regulator support part 51*a*. The regulator support part 51*a* also has a rectangular shape, as seen in the plate thickness direction, and sides to which both the ends continue are long sides. Also, the regulator support part 51*a* is formed with through-holes (not shown) for inserting regulation handles 53*a* for regulating a pressure of a compressed air in each regulator 53, in a form of corresponding to each regulator 53.

Note that, both the bent end portions of the regulator panel 51 are parts for supporting the exterior cover 7 of the loom, and are configured as cover support parts 51*c*. The regulator panel 51 also has a base mount attaching part 51*b* that is a part for attaching the regulator panel 51 to the base mount 23 of the display setting device 20. The base mount attaching part 51*b* is formed to continue to a side edge of one end-side in the long side direction of the regulator support part 51*a*.

As shown in FIG. 3, the base mount attaching part 51*b* is formed so that apart on a tip end-side forms a substantial L-shape bent at a substantial right angle with respect to the part continuing to the regulator support part 51*a*. The bending direction is opposite to a direction in which the cover support part 51*c* is bent with respect to the regulator support part 51*a*. A portion of the base mount attaching part 51*b* on a further tip end side than the bent part is formed as an attaching portion 51*b*1 that is a portion for attaching the regulator panel 51 to the base mount 23. Note that, as shown in FIG. 4, a dimension of the base mount attaching part 51*b* in the short side direction of the regulator support part 51*a* is substantially the same as the dimension in the width direction of the base mount 23 of the display setting device 20.

The regulator panel 51 is attached at the attaching portion 51*bi* of the base mount attaching part 51*b* to the base portion 23*a*1 of the base mount 23 of the display setting device 20. The attachment is made in a state where the cover support part 51*c* is made to face forward, as shown in FIG. 3. In addition, the attachment is made in a state where the short side direction of the regulator support part 51*a* is made to match the width direction of the base mount 23 and the position of the regulator panel 51 in the width direction is made to match the position of the base portion 23*a*1 of the base mount 23, as shown in FIG. 4. Note that, the attachment is made using screw members 53. The regulator panel 51 is attached to the base mount 23 of the display setting device 20, so that the regulator panel 51 is in a state of being suspended from the base mount 23.

Also, each regulator 53 is attached to the regulator panel 51. Note that, as shown in FIG. 2, the attachment is performed using screw members (not shown) in a state where each regulator 53 is in contact with a rearward facing surface of the regulator support part 51*a* in the corresponding portion of the regulator support part 51*a* (the portion in which the through-hole is formed). The regulation handles 53*a* are attached to the corresponding regulators 53 in a form of passing through the through-holes.

The regulator panel 51 is also configured to support the exterior cover 7 of the loom, as described above. Therefore, the exterior cover 7 is attached to two cover support parts 51*c* and 51*c* of the regulator panel 51. Additionally describing, as shown in FIGS. 1 and 2, in a state of being attached to the regulator panel 51, the exterior cover 7 is configured to cover the front and the sides of the regulator panel 51 and the surrounding of the display panel 21 of the display setting device 20.

Also, the regulator panel 51 is connected to the electric component box 61 via a connecting member 67, as described above. The electric component box 61 is provided in a form of being supported by the side frame 2*a* via the elastic members.

More specifically, the electric component box 61 is provided on the base member 63 attached to the side frame 2*a*, as described above, and is thus supported by the side frame 2*a*. In addition, ring-shaped support rings 65 are mounted between the electric component box 61 and the base member 63.

Specifically, as shown in FIG. 2, support pins 69 are attached to four corners of the bottom surface of the electric component box 61 while facing downward. The base member 63 is formed with through-holes (not shown) in positions corresponding to the support pins 69, considering the arrangement of the electric component box 61 as described above. In addition, the electric component box 61 is placed on the base member 63 in such an aspect that the support pins 69 are each inserted into each of the support rings 65 and protruding portions of the support pins 69 from the support rings 65 are inserted into the through-holes of the base member 63. The protruding portions of the support pins 69 from the base member 63 are attached with ring-shaped snap rings (not shown) for preventing the support pins 69 from separating from the through-holes. As a result, the electric component box 61 is supported (attached) on the base member 63 via the elastic members (support rings 65).

In addition, the electric component box 61 and the regulator panel 51 are connected to each other via the connection member 67. As shown in FIGS. 1 and 2, the connecting member 67 is formed by a plate member having a rectangular shape, as seen in a plate thickness direction. In addition, the connecting member 67 is configured as a member having a substantial L-shape where a part on one end-side in a length direction is bent to be substantially orthogonal in the plate thickness direction. The connecting member 67 is attached at the bent part on one end-side to the front surface 61*a* of the electric component box 61 and is attached at an end portion on the other end-side to the outer cover support part 51*c* of the two cover support parts 51*c* and 51*c* of the regulator panel 51. Thereby, the regulator panel 51 and the electric component box 61 are connected to each other via the connecting member 67.

According to the air jet loom 1 of the present embodiment configured as described above, as the vibration-proof structure for the display setting device 20, the structure where the regulator panel 51, which is the support structure member provided to the loom, is suspended from the base mount 23 is adopted, in addition to the structure where the base mount 23 of the display setting device 20 is supported by the two support stays 31 and 31 (support members) of the support mechanism 30 via the support rings 41 (elastic members). Also, the plurality of regulators 53 is supported by the regulator panel 51. In this way, in the vibration-proof structure, the regulator panel 51 and the regulators 53 as well as the display setting device 20 are supported by the support mechanism 30 via the base mount 23 and the support rings 41.

Therefore, in the vibration-proof structure, the centers of gravity of the supported objects are positioned lower, as compared to a case where the supported object to be supported by the support mechanism 30 is only the display setting device 20. Thereby, in the vibration-proof structure, the vibrations of the supported objects are suppressed, as compared to the case where the supported object is only the display setting device 20. As a result, the vibrations of the display setting device 20 included in the supported objects are also suppressed, so that the malfunction of the display panel 21 of the display setting device 20 can be prevented as much as possible.

In addition, in the air jet loom 1 of the present embodiment, the exterior cover 7 of the loom is supported by the regulator panel 51. In other words, the exterior cover 7 is also included in the supported objects. According to this configuration, the vibrations of the loom frame 2 (side frame 2*a*) are not directly transmitted to the exterior cover 7. Thereby, the vibrations of the supported object itself are suppressed as described above, and the damage of the exterior cover 7 can be prevented as much as possible.

In addition, in the air jet loom 1 of the present embodiment, the regulator panel 51 suspended from the base mount 63 as described above is connected with the electric component box 61 provided on the outer side of the side frame 2*a* in the same position with respect to the width direction by the connecting member 67. Further, the electric component box 61 is supported by the side frame 2*a* via the support rings 65 (elastic members). Thereby, in this configuration, a part of the weight of the electric component box 61 is applied to the regulator panel 51. Therefore, as compared to a case where only the regulator panel 51 is suspended from the base mount 23 of the display setting device 20, the position of the center of gravity of the supported object is positioned further lower. As a result, the vibrations of the display setting device 20 itself are further suppressed.

Note that, the present invention is not limited to the above embodiment, and can also be implemented in following modified embodiments.

(1) As for the support structure member (hereinafter, referred to as 'target support structure member') suspended from the base mount, in the above embodiment, the premised loom is the air jet loom 1, and the target support structure member is the regulator panel 51 for supporting the regulators 53 configured to regulate the pressure of the compressed air that is supplied to the weft insertion nozzles. Also, in the above embodiment, the regulator panel 51 is also configured to support the exterior cover of the loom and thus serves as the cover bracket. Specifically, the regulator panel and the cover bracket are the target support structure members. However, in the present invention, in the case where the premised loom is the air jet loom, like the above embodiment, even when the regulator panel is used as the target support structure member, the target support structure member may be configured to support only the regulators (i.e., not to support the exterior cover).

Further, in the present invention, the target support structure member may be a support structure member provided in a position in which it can be suspended from the display setting device (base mount), as the support structure member provided for the general loom, and for example, may be a cover bracket configured to support only the exterior cover of the loom. In a case where a support structure member other than the regulator panel is used as the target support structure member, the present invention can be applied to a loom (a water injection type loom, a rapier loom and the like) other than the air jet loom.

(2) In the above embodiment, the vibration-proof structure has the configuration where the regulator panel 51 as the target support structure member is connected to the electric component box 61 via the connecting member 67. Specifically, when the premised loom has the electric component box, the vibration-proof structure is configured so that the target support structure member is connected to the electric component box. However, in the present invention, the vibration-proof structure is not limited to the configuration and may be configured so that the target support structure member is not connected to the electric component box.

Note that, the electric component box 61 is supported by the side frame 2*a* via the base member 63 attached to the side frame 2*a*, and in the above embodiment, the base member 63 is a plate-shaped member. However, the base member is not limited to the plate-shaped member, and may be, for example, a prismatic columnar member. However, in a case where the base member is a prismatic columnar member, the base member is provided so that the electric component box is supported by the two or more base members.

(3) As for the support mechanism of the premised loom, in the above embodiment, the support mechanism 30 includes the two support stays 31 and 31 as the support members, which are members each mainly consisting of a hexagonal columnar part, and the support plates 33, which are the plate-shaped members each attached to each of the support stays 31 and 31, and is configured to support the base mount 23 on the support plates 33 supported by the support stays 31. In other words, the support mechanism 30 is configured so that the support plates 33 configured to support the base mount 23 are supported on the side frame 2*a* by the support stays 31.

However, the support mechanism of the loom premised in the present invention is not limited to the configuration, and may also be configured so that the base mount is directly placed on the support stays (support members) without the support plates. Note that, in this case, the support stay may be formed with through-holes and may be configured to support the base mount via the elastic member like the above embodiment by inserting support pins equivalent to the support pins 43 of the above embodiment into the through-holes. Also, the support mechanism may be configured so that the plate-shaped support plates are directly attached to the side frame without the support stays. In this case, the support plate becomes the support member.

In the above embodiment, the support mechanism 30 is configured to support the base mount 23 at the two places of the base portion 23*a*1 and the support portion 23*b*2 of the base mount 23. Specifically, the support mechanism includes the two support members, and is configured to support the base portion of the base mount by one of the two support members and to support the other portion of the base mount by the other support member. However, the support mechanism is not limited to the configuration, and even when the two support members are included, the support mechanism may be configured to support the base portion of the base mount by the two support members.

In addition, the number of the support members included in the support mechanism is not limited to two, like the above embodiment, and may be three or more or one. However, when the support member is one, a dimension of the support member in a direction coinciding with the front and rear direction is preferably made larger than the dimension of the support plate of the above embodiment so as to stably support the base mount. More preferably, the elastic members are arranged in different positions on the one support member in the front and rear direction so as to support the base mount.

In a case where the support mechanism is configured so that the base portion of the base mount is supported by the two or more support members, like the above, a position in which the support structure member is suspended may be set to be the same as the one support member (joint fastening/fixing by a common screw member, for example).

Note that, the present invention is not limited to the above-described example, and can be appropriately changed without departing from the gist of the present invention.

What is claimed is:

1. A loom comprising: a display setting device comprising a display panel and a base mount to which the display panel is attached; a support mechanism configured to support the display setting device on the base mount via a support member attached to a side frame of a loom frame and extending toward an outer side of the frame; and a vibration-proof structure configured to support the base mount on the support member of the support mechanism via an elastic member, the loom being characterized in that the vibration-proof structure has a configuration where a support structure member provided to the loom is suspended from the base mount.

2. The loom according to claim 1, wherein the loom is an air jet loom comprising a regulator for regulating a pressure of a compressed air to be supplied to a weft insertion nozzle, and wherein the support structure member is a regulator panel configured to support the regulator.

3. The loom according to claim 1, wherein the support structure member is a cover bracket configured to support an exterior cover of the loom.

4. The loom according to claim 2, wherein the support structure member is a cover bracket configured to support an exterior cover of the loom.

5. The loom according to claim 1, wherein the loom is an air jet loom comprising an electric component box in which an electric component for controlling an operation of the loom is accommodated, the electric component box being supported by the side frame via a base member attached to the side frame and being arranged in the vicinity of the support structure member on an outer side of the frame, and wherein the electric component box is attached to the base member via an elastic member, and the support structure member and the electric component box are connected to each other via a connecting member.

6. The loom according claim 2, wherein the loom is an air jet loom comprising an electric component box in which an electric component for controlling an operation of the loom is accommodated, the electric component box being supported by the side frame via a base member attached to the side frame and being arranged in the vicinity of the support structure member on an outer side of the frame, and wherein the electric component box is attached to the base member via an elastic member, and the support structure member and the electric component box are connected to each other via a connecting member.

7. The loom according to claim 3, wherein the loom is an air jet loom comprising an electric component box in which an electric component for controlling an operation of the loom is accommodated, the electric component box being supported by the side frame via a base member attached to the side frame and being arranged in the vicinity of the support structure member on an outer side of the frame, and wherein the electric component box is attached to the base member via an elastic member, and the support structure member and the electric component box are connected to each other via a connecting member.

8. The loom according to claim 4, wherein the loom is an air jet loom comprising an electric component box in which an electric component for controlling an operation of the loom is accommodated, the electric component box being supported by the side frame via a base member attached to the side frame and being arranged in the vicinity of the support structure member on an outer side of the frame, and wherein the electric component box is attached to the base member via an elastic member, and the support structure member and the electric component box are connected to each other via a connecting member.

* * * * *